US007515063B2

(12) United States Patent
Brundula

(10) Patent No.: US 7,515,063 B2
(45) Date of Patent: Apr. 7, 2009

(54) AUTOMATIC GARAGE DOOR CLOSING DEVICE

(76) Inventor: Steven Nigel Dario Brundula, 113 S. Lakeview Blvd., Chandler, AZ (US) 85225

( * ) Notice: Subject to any disclaimer, the term of this patent is extended or adjusted under 35 U.S.C. 154(b) by 103 days.

(21) Appl. No.: 11/294,665

(22) Filed: Dec. 5, 2005

(65) Prior Publication Data

US 2006/0158339 A1 Jul. 20, 2006

Related U.S. Application Data

(60) Provisional application No. 60/634,059, filed on Dec. 7, 2004.

(51) Int. Cl.
*G08C 19/00* (2006.01)

(52) U.S. Cl. ..... 340/825.69; 340/825.72; 340/5.7; 340/5.71; 340/539.1

(58) Field of Classification Search ..... 340/5.71, 340/5.7, 539.1, 825.69, 825.72; 341/76, 341/176; 318/280, 286, 383, 445; 49/17, 49/25, 28

See application file for complete search history.

(56) References Cited

U.S. PATENT DOCUMENTS

| | | | |
|---|---|---|---|
| 4,386,398 | A | 5/1983 | Matsuoka et al. |
| 4,463,292 | A | 7/1984 | Engelmann |
| 4,939,434 | A | 7/1990 | Elson |
| 5,752,343 | A | 5/1998 | Quintus |
| 6,046,562 | A | 4/2000 | Emil |
| 6,070,361 | A | 6/2000 | Paterno |
| 6,243,010 | B1 | 6/2001 | Addy et al. |
| 6,437,527 | B1 | 8/2002 | Rhodes et al. |
| 6,445,291 | B2 | 9/2002 | Addy et al. |
| 6,563,278 | B2 | 5/2003 | Roman |
| 6,819,071 | B2 | 11/2004 | Graham et al. |
| 2003/0090375 | A1 | 5/2003 | Addy et al. |
| 2003/0216139 | A1 | 11/2003 | Olson et al. |
| 2004/0135531 | A1 | 7/2004 | Graham et al. |

*Primary Examiner*—Hung T. Nguyen
(74) *Attorney, Agent, or Firm*—Letham Law Firm LLC; Lawrence Letham

(57) ABSTRACT

A detector that resides inside of a garage with a working wireless electric garage door opener, the detector detects when the garage door is open for too long and when the garage door is open too long the detector sends out warnings, then after the appropriate conditions occur the detector can close the garage door. The detector additionally requires no special installation of sensors or wires.

20 Claims, 4 Drawing Sheets

AUTOMATIC GARAGE DOOR CLOSING DEVICE

CROSS REFERENCE TO RELATED APPLICATIONS/REFERENCES CITED

Prior Application filed is a provisional patent
Application number: 60/634,059
Filing date: Dec. 7, 2004
Title: Automatic Garage Door Closing Device
Inventor: Steven Nigel Dario Brundula

PATENTS CONTAINING PRIOR ART FOR REFERENCE ONLY

U.S. Pat. No. 4,386,398 May, 1983 Matsuoka et al. 700/90.
U.S. Pat. No. 4,463,292 July, 1984 Engelmann 318/283.
U.S. Pat. No. 4,939,434 July, 1990 Elson 318/285.
U.S. Pat. No. 5,752,343 May, 1998 Quintus.
U.S. Pat. No. 6,046,562 April, 2000 Emil 318/484.
U.S. Pat. No. 6,437,527 August, 2002 Rhodes et al. 318/280.
U.S. Pat. No. 6,563,278 May, 2003 Roman 318/282.
U.S. Pat. No. 6,819,071 January, 2003 Graham; Kenneth B. 318/442

TECHNICAL FIELD

The technical field of this device is in electronics. The more specific areas of electrical expertise needed for this product is digital electronics for the control and timing circuitry, analog electronic knowledge for the alarm and device powering considerations (the whole design can be done in analog circuitry if preferred), and wireless RF electronic experience (although if a universal garage door design is purchased and interfaced no RF experience is necessary).

BACKGROUND

Most people who have a garage door have accidentally left it open. Leaving the garage door open can have consequences such as; having belongings stolen from the garage or even the house, animals such as snakes can enter the garage to live, and in colder climates pipes can freeze and break. Prior art has come up with devices to fix this issue but are too cumbersome to use. Wires need to be connected, sensors need to be mounted, usually expensive, complicated and time consuming. This led to the idea of creating a device that can be mounted on a garage door, powered off of a battery, work with existing garage door openers, provide a warning before closing the door, and be very simple to install.

SUMMARY OF INVENTION

The Background has led to two most probable and different devices, 1) the first and the simplest is a device that mounts to the inside of a garage door and detects the tilt of the garage door. When the garage door is not perpendicular to the ground for greater than a certain amount of time, the module sets off an alarm. A certain amount of time after that if the garage door is still not perpendicular to the ground and the device has not been turned off, a signal is sent to the garage door opener to close the garage door or to a wall mounted module that presses the garage door open/close button to close the garage. 2) The second device is almost the same as the first except that instead of setting off an alarm, it sends a phone call or text message to a specified phone number. Replying by pressing a touch-tone button on the phone or a text message with a specific message will tell the device to try and close the garage door.

DETAILED DESCRIPTION

Device 1 (see FIG. 3) consists of a sensor such as a tilt sensor, a universal garage door remote or wall-mounted device to press the garage door open close button (see FIG. 2 and FIG. 4), control inputs/switches, a system controller, and an alarm device(s).

Device 2 would be the same as Device 1, as it would contain a sensor a universal garage door remote or wall mounted device to press the garage door open/close button, control inputs/switches, a system controller, and an alarm device; in addition however it would also contain a telephone module to make the module contain a cell phone, or it would talk to another module that is plugged into a phone line.

The sensor could be one or more of many different devices, such as measurement sensors to measure the distance the garage door is off the floor, or tilt sensors to measure the tilt of the garage door. Due to simplicity the tilt sensor would be preferable.

The universal garage door remote is what stores all the codes to all the different garage doors; this allows one product capable of working on thousands of different garage doors. When the universal garage door remote is signaled, the universal garage door remote transmitter sends an RF signal to the garage door opener to close the garage door. An alternative to using the universal garage door remote would be to send a wireless signal to a module that would press the garage door open/close button (see FIG. 2).

The alarm device(s) are audible and/or visual; the purpose is to warn anyone around the garage door that the door is going to soon close. Most probably a flashing light and a siren or beep would be the preferable alarm method. Another probable alarm device is a device that calls a phone number if the garage door is open too long. The additional device can be a module that plugs into a standard phone line, or a separate mobile phone built into the automatic garage door closing device.

The control inputs/switches control a) turning on and off the device, b) programming the universal remote for a specific garage door type, c) changing the values of how long the garage door can be open before the alarm goes off, d) change how long the alarm goes off before the signal is sent to close the garage door, and e) to change the phone number to send a text message to warning that the garage door is open. The device would also need to have a method to show the current settings so a simple to complex display can be used to show setting values.

The system controller regulates the operation of the device; the operation it performs is the following. If the door is sensed to be open, the controller waits a specified amount of time for the garage door to close. If after this variable time the garage door is still not closed and the phone module is not part of this system then the controller starts the alarm(s). The alarm will continue for another specified amount of time and if by the end of that time the garage door is still open, the controller then sends an appropriate signal to close the garage door. If the phone module is part of the system then a phone call or text message is sent to a specified phone number. The phone module then waits for a response such as the press of a specific touch-tone button, or to receive a text message. Pressing different options can do different things, returning/pressing 1 closes the garage door, 2 leaves the garage door open and doesn't warn you anymore, 3 leaves the garage door open and will warn you again after a specified amount of time if the garage door has still not been closed.

The controller also checks the status of the input switches/sensors to see if any of the system parameters such as delay time until sending off an alarm is to be changed. A potentiometer or switch that rotates adjusts the amount of time delay from when the door is opened until an alarm goes off, a toggle switch turns the system on and off. The phone module includes a display to show the phone number to call when the garage door is open. All systems have indicator lights to show if any of the batteries are going low, when the batteries are low alarms also go off but with different intensities to warn the user to change the system batteries.

All the sensors and features built into a garage door opener continue to work and are not inhibited with this device. Likewise if a car or a person blocks a door sensor, this device will try but will not be able to close the garage door.

Figure 1:
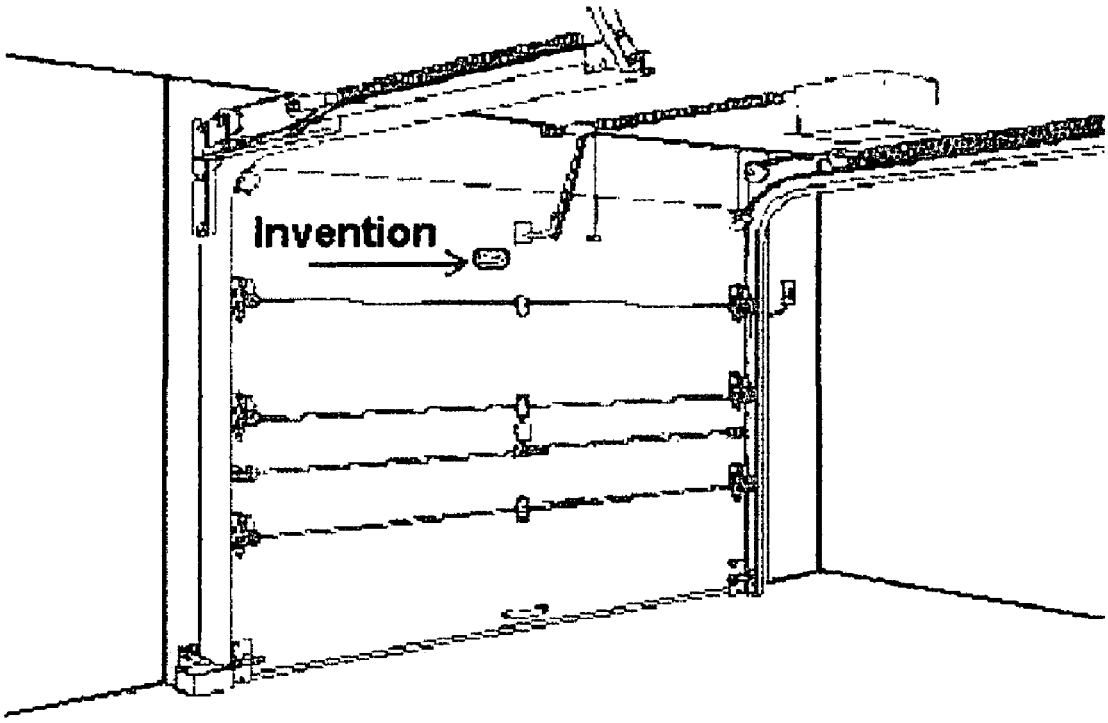
FIG. 1: An illustration of how one of the devices may look mounted to a garage door.
Figure 2:
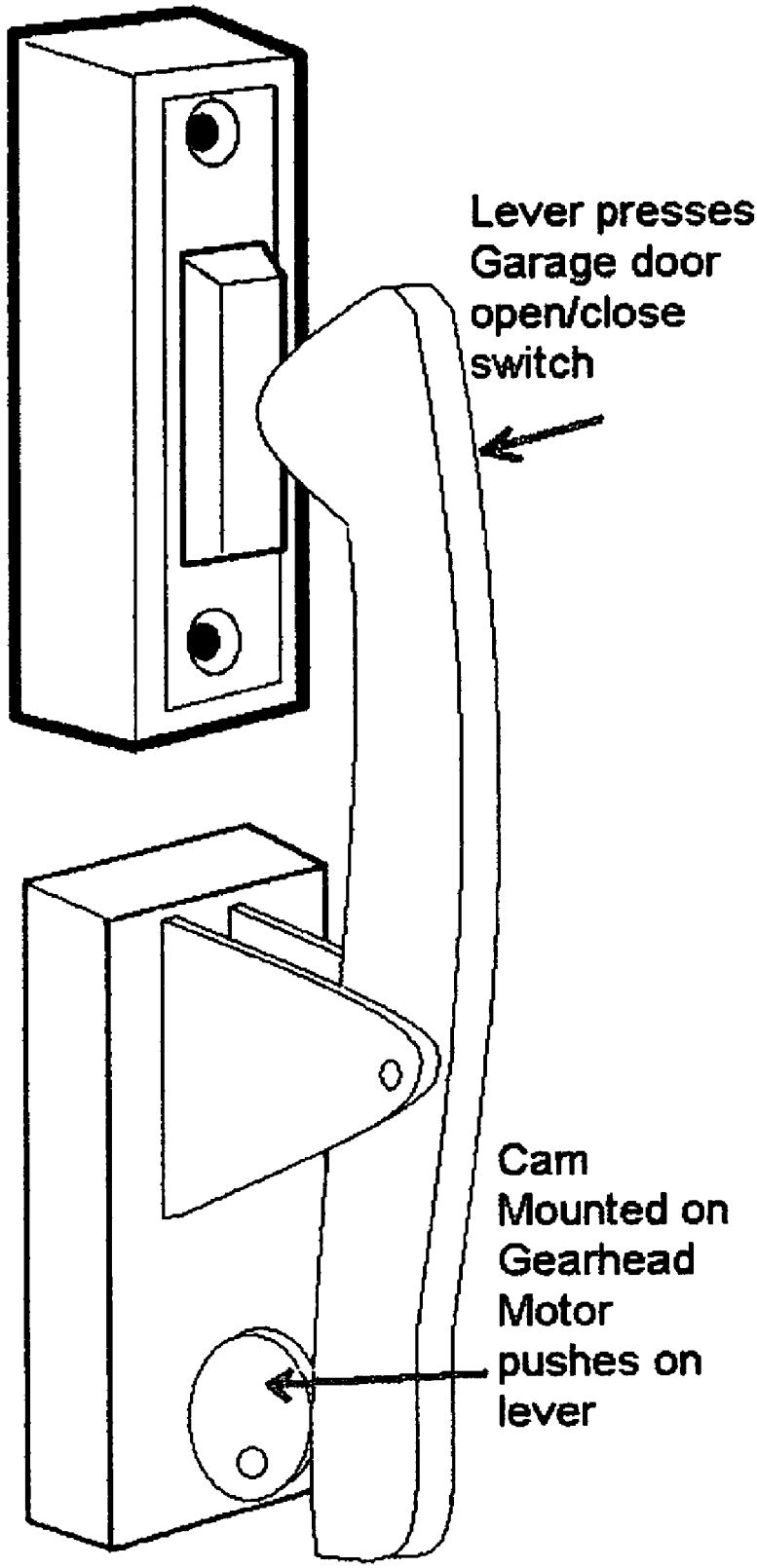
FIG. 2. Illustration of a device that can press a garage door button and close a garage door.
Figure 3:
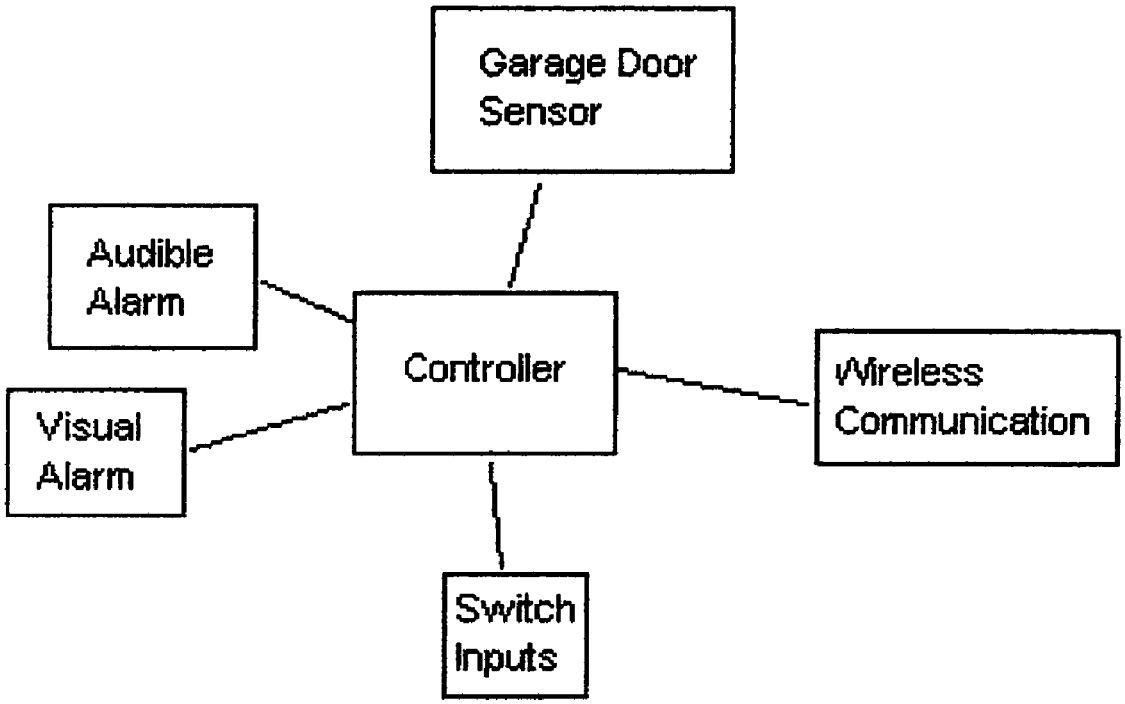
FIG. 3: High-level block diagram of an automatic garage door closer with an RF transmitter that sends the same signal as a garage door remote to close the garage door.
Figure 4:
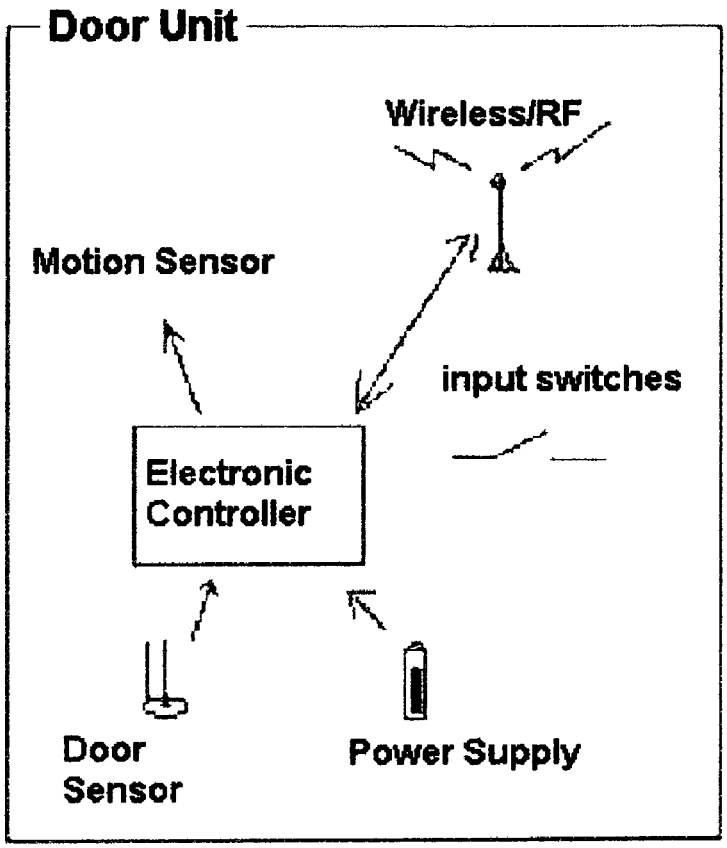
FIG. 4: High-level block diagram of an automatic garage door closer that presses the garage door open/close button on the wall to close the garage door.
Figure 4:
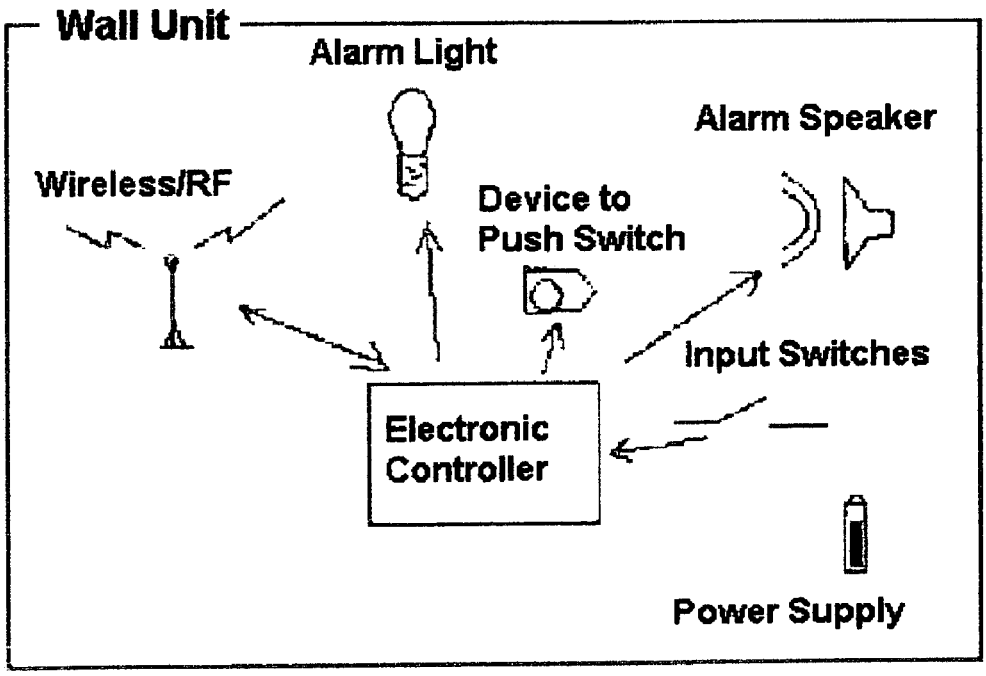

The invention claimed is:

1. A detector for controlling a provided garage door opener, wherein the garage door opener moves a garage door between an open position and a closed position responsive to wirelessly receiving a code, the detector comprising:

a body;

a sensor that detects the open position of the garage door;

a controller that provides a plurality of signals responsive to the sensor and in accordance with at least one setting of a plurality of settings;

a wireless transmitter that responsive to a first signal of the plurality of signals transmits the code to close the garage door; and a battery that provides a power to operate the detector; wherein:

no wire external to the body couples to the body;

the sensor, the controller, the transmitter, and the battery are mounted inside the body; and the body is mounted to a portion of the garage door.

2. The detector of claim 1 wherein the sensor comprises a tilt sensor.

3. The detector of claim 1 wherein the sensor detects a distance that a bottom portion of the garage door is above a floor.

4. The detector of claim 1 further comprising a wireless device, wherein responsive to a second signal of the plurality of signals and in accordance with at least one setting of the plurality of settings, the wireless device dials a phone number.

5. The detector of claim 1 further comprising a wireless device, wherein responsive to a second signal of the plurality of signals and in accordance with at least one setting of the plurality of settings, the wireless device sends a first text message to notify a user.

6. The detector of claim 5 wherein:

the wireless device receives a confirmation from the user; and responsive to the confirmation, the controller provides the first signal of the plurality of signals.

7. The detector of claim 5 wherein the wireless device comprises at least one of a mobile phone and a pager.

8. The detector of claim 1 further comprising a device coupled to a wired phone line that responsive to a second signal of the plurality of signals and in accordance with at least one setting of the plurality of settings dials a phone number to notify a user.

9. The detector of claim 8 wherein:

the device coupled to a wired phone line receives a confirmation from the user; and responsive to the confirmation, the controller provides the first signal of the plurality of signals.

10. The detector of claim 1 further comprising an email device that responsive to a second signal of the plurality of signals and in accordance with at least one setting of the plurality of settings sends an email to notify the user.

11. The detector of claim 10 wherein:

the email device receives a confirmation from the user; and responsive to the confirmation, the controller provides the first signal of the plurality of signals.

12. The detector of claim 1 wherein the controller provides an alarm responsive to the sensor and in accordance with at least one setting of the plurality of settings.

13. The detector of claim 12 wherein the alarm comprises at least one of an audible sound and a flashing light.

14. The detector of claim 1 further comprising at least one input control for receiving the plurality of settings from a user.

15. The detector of claim 1 wherein the plurality of settings comprises a phone number, a text message, a email address, an email message, a duration of time to wait before providing the first signal, a duration of time to wait before providing an alarm, and a specific garage door opener type.

16. The detector of claim 1 further comprising a display for presenting a presentation of the plurality of settings.

17. The detector of claim 1 wherein the code comprises a code for controlling a specific garage door opener type.

18. A detector for controlling a provided garage door opener, wherein the garage door opener moves a garage door between an open position and a closed position responsive to pressing a button, the detector comprising:

a body comprising:

a sensor that detects the open position of the garage door;

a controller that provides a plurality of signals responsive to the sensor and in accordance with at least one setting of a plurality of settings; and a wireless transmitter that responsive to a first signal of the plurality of signals transmits an RF signal; and an actuator that responsive to receiving the RF signal pushes the button; wherein:

no wire external to the body couples to the body; and the body is mounted to a portion of the garage door.

19. A detector for controlling a provided garage door opener, wherein the garage door opener moves a garage door between an open position and a closed position responsive to receiving a code, the detector comprising:

a first unit mounted to a portion of the garage door, the first unit comprising:

a sensor that detects the open position of the garage door; and an RF transmitter that responsive to the sensor transmits an RF signal; and a second unit comprising:

an RF receiver that receives the RF signal;

a controller that provides a plurality of signals responsive to the RF receiver and in accordance with at least one setting of a plurality of settings;

a module that responsive to a first signal of the plurality of signals calls a number; and a wireless transmitter that responsive to a second signal of the plurality of signals transmits the code to close the garage door; wherein:

no wire external to the first unit couples to the first unit.

20. A method performed by a detector for closing a garage door, wherein a garage door opener moves the garage door between an open position and a closed position responsive to wirelessly receiving a code, the method comprising:

detecting the open position of the garage door;

after expiration of a first period, providing a warning to a user that the garage door is in the open position; and after at least one of receiving a confirmation from the user and an expiration of a second period, wirelessly transmitting a code to the opener to close the garage door; wherein:

the detector is mounted to a portion of the garage door; and no wire external to the detector couples to the detector.

* * * * *